US008999212B2

(12) United States Patent
Koenders et al.

(10) Patent No.: US 8,999,212 B2
(45) Date of Patent: Apr. 7, 2015

(54) PROCESS FOR SPINNING GRAPHENE RIBBON FIBERS

(75) Inventors: Bernardus Maria Koenders, Westervoort (NL); Jacobus Johannes Meerman, Arnhem (NL); Stephanus Maria Kamperman, Doesburg (NL); Ron Folkert Waarbeek Ter, Zevenaar (NL); Jorrit Jong De, Arnhem (NL); Angelique Antonia Theresia Hendrikus Radier, Arnhem (NL); Marcin Jan Otto, Elst (NL)

(73) Assignee: Teijin Aramid B.V., Arnhem (NL)

( * ) Notice: Subject to any disclaimer, the term of this patent is extended or adjusted under 35 U.S.C. 154(b) by 391 days.

(21) Appl. No.: 13/636,063

(22) PCT Filed: Mar. 17, 2011

(86) PCT No.: PCT/EP2011/054012

§ 371 (c)(1),
(2), (4) Date: Sep. 19, 2012

(87) PCT Pub. No.: WO2011/134717

PCT Pub. Date: Nov. 3, 2011

(65) Prior Publication Data

US 2013/0009337 A1 Jan. 10, 2013

(30) Foreign Application Priority Data

Apr. 28, 2010 (EP) ..... 10161324

(51) Int. Cl.

| | |
|---|---|
| ***D01D 7/00*** | (2006.01) |
| ***D01D 10/00*** | (2006.01) |
| ***D01D 10/06*** | (2006.01) |
| ***D01F 11/10*** | (2006.01) |
| ***D06M 10/00*** | (2006.01) |
| ***D01D 5/06*** | (2006.01) |
| ***D01F 9/12*** | (2006.01) |

(52) U.S. Cl.
CPC ... *D01D 5/06* (2013.01); *D01F 9/12* (2013.01)

(58) Field of Classification Search
CPC ..... D01D 5/06; D01D 7/00; D01D 10/00; D01D 10/06; D01F 9/12; D01F 11/10
USPC ..... 264/28, 179, 180, 181, 183, 211.15, 264/211.16, 233
See application file for complete search history.

(56) References Cited

U.S. PATENT DOCUMENTS 5,151,227 A * 9/1992 Nguyen et al. ..... 264/179
2007/0243124 A1 10/2007 Baughman et al.

(Continued)

FOREIGN PATENT DOCUMENTS

JP 59026509 A * 2/1984 ..... 264/180
WO WO 02/055769 7/2002

OTHER PUBLICATIONS

May 23, 2011 International Search Report cited in PCT/EP2011/054012.
Dec. 1, 2011 Written Opinion cited in PCT/EP2011/054012.

*Primary Examiner* — Leo B Tentoni
(74) *Attorney, Agent, or Firm* — Oliff PLC

(57) ABSTRACT

A graphene ribbon fiber manufacturing process, where a coagulation medium flows in the same direction as the graphene ribbon fibers. The process for spinning graphene ribbon fibers starts with unzipping carbon nanotubes to form graphene ribbons, purifying and drying the graphene ribbons and subsequent dissolving of the graphene ribbons in a suitable solvent, preferably a super acid to form a spin-dope. The spin-dope is spun such that the accrued fibers are guided into a coagulation medium, also known as anti-solvent, where the spun or accrued fibers are coagulated. The coagulated graphene ribbon fibers are stripped, neutralized and washed and wound on bobbins.

15 Claims, 4 Drawing Sheets

(56) References Cited

U.S. PATENT DOCUMENTS

2009/0226361 A1 9/2009 Campos-Delgado et al.
2011/0110843 A1* 5/2011 Pasquali et al. ..... 423/447.2
2012/0063988 A1* 3/2012 Tour et al. ..... 423/415.1
2013/0098833 A1* 4/2013 Sun et al. ..... 210/500.25

* cited by examiner

PROCESS FOR SPINNING GRAPHENE RIBBON FIBERS

SUMMARY

A spin-dope comprising graphene ribbons is supplied to a spinneret and the spin-dope is spun into accrued graphene ribbon fibers, which are guided into a coagulation medium, also known as anti-solvent, where the spun or accrued fibers are coagulated. The coagulated graphene ribbon fibers are stripped to remove excess coagulation medium, optionally neutralized and washed, and wound on bobbins.

The spin-dope can be formed by dissolving of the graphene ribbons in a suitable solvent, preferably a super acid. Optionally, the process of forming a spin-dope can comprise one or more of the following steps of purifying carbon nanotubes, unzipping the carbon nanotubes into graphene ribbons, purifying the graphene ribbons and drying of the graphene ribbons.

DETAILED DESCRIPTION OF EMBODIMENTS

Figure 1:
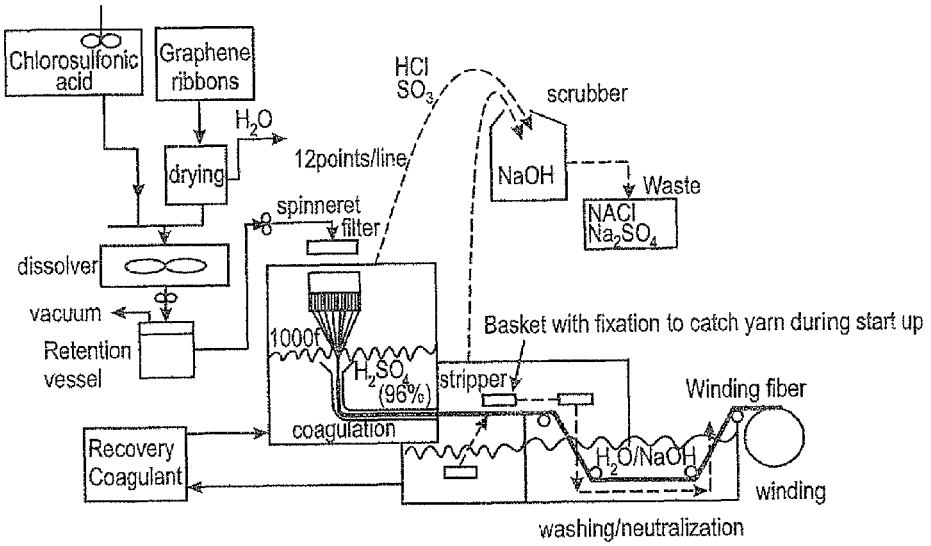
FIG. 1 schematically represents an embodiment of a process for manufacturing graphene ribbon fibers according to an embodiment including a transport tube consisting of a vertical and a horizontal part.

Current state-of-the-art high-performance fibers are composed predominantly of carbon, for example KEVLAR, TWARON, ZYLON, or solely of carbon, for example PAN or pitch-based carbon fibers. Yet, because of structural imperfections, present-day fibers realize only a small fraction, generally below 10%, of the strength of the carbon-carbon molecular bond. Control over nanostructure, from starting precursor material all the way to the final fiber, is the key challenge that must be met for improvement of high performance fibers. Besides carbon nanotubes, graphene ribbons are well suited for spinning high performance fibers. Graphene ribbons are more flexible than carbon nanotubes, which is an advantage in the production process as well as in the final products. Such high-performance graphene ribbon fibers can be used, for example, in yarns, nonwovens, membranes and films.

Graphene ribbons can be made by alternative methods, such as cutting graphene ribbons from larger graphene sheets using chemical methods. However, cutting graphene ribbons according to these methods offer little control over the width of the graphene ribbons. Unzipping carbon nanotubes by snipping along the length of the carbon nanotubes, offers full control of the width of the produced graphene ribbons.

The process for spinning graphene ribbons into fibers comprises the steps of supplying a spin-dope containing graphene ribbons to a spinneret and spinning the spin-dope into a bundle of accrued graphene ribbon fibers. The bundle of accrued fibers can consist of any number of fibers, ranging from one fiber to produce monofilaments to several thousands to produce multifilament graphene ribbon yarns. The accrued fibers are coagulated in a coagulation medium, preferably sulphuric acid or trichloromethane, the coagulated fibers are mechanically stripped to remove excess coagulation medium, optionally neutralized and washed and wound on bobbins. Preferably, the coagulated fibers are neutralized and washed.

A spin-dope can be formed by dissolving graphene ribbons, cut from larger graphene sheets using chemical methods, in a suitable solvent, preferably a super acid, more preferably chlorosulfonic acid or oleum, to form a spin-dope. Preferably, the spin-dope is formed by purifying carbon nanotubes (CNT) to remove non-CNT components such as amorphous carbon, graphite and catalyst residue, unzipping the carbon nanotubes into graphene ribbons, optionally drying the graphene ribbons and subsequent dissolving the graphene ribbons in a suitable solvent, preferably a super acid, more preferably chlorosulfonic acid or oleum, to form a spin-dope.

The spin-dope is spun such that the accrued fibers are guided into a coagulation medium, also known as anti-solvent, where the spun or accrued fibers are coagulated. Suitable anti-solvents to be used as coagulation medium are for example sulphuric acid, PEG-200, dichloromethane, trichloromethane, tetrachloromethane, ether, water, alcohols, such as methanol, ethanol and propanol, acetone, N-methyl pyrrolidone (NMP) or dimethylsulfoxide (DMSO).

Preferably, the graphene ribbon fibers are spun from a spin-dope comprising oleum as a solvent into water as a coagulation medium.

The accrued fibers can be spun directly into the coagulation medium, but preferably the accrued fibers are guided into the coagulation medium via an air gap. In this air gap the accrued graphene ribbon fibers can be accelerated to increase the orientation in the fibers and the air gap avoids direct contact between spinneret and coagulation medium.

The coagulation of the accrued graphene ribbon fibers is influenced by many different variables such as the concentration of graphene ribbons in the spin-dope, additives added to the spin-dope, temperature of the spin-dope, number of accrued graphene ribbon fibers and the diameter of the accrued graphene ribbon fibers.

The composition and concentration of the coagulation medium and/or the temperature of the coagulation bath can be used to tune the coagulation speed and to control the drawability of the accrued graphene ribbon fibers and the orientation of the graphene ribbons in the final fiber.

It is known to use 96% sulphuric acid as a coagulation medium in the field of spinning carbon nanotubes (CNT) fibers in very small experimental equipment and utilizing only very small amounts of solvent. It has now been found that the concentration of sulphuric acid in the coagulation medium influences the reaction of chlorosulfonic acid in sulphuric acid. At high sulphuric acid concentration in the coagulation medium, for example 96% sulphuric acid, the reaction is slow. The lower the concentration of sulphuric acid in the coagulation medium becomes, the faster the reaction of chlorosulfonic acid is. For example, when 70% sulphuric acid was used as a coagulation medium, the reaction was significantly faster than with 96% sulphuric acid, but still controllable. The reaction of chiorosulfonic acid with a coagulation medium containing only water, i.e. 0% sulphuric acid, became very violent.

Coagulation medium of different concentrations can be used to control the coagulation speed of the accrued graphene ribbon fibers in the coagulation medium. Preferably, the coagulation medium is sulphuric acid having a concentration in the range of 70% to 100%, more preferably in the range of 90% to 100%.

At high concentrations of sulphuric acid in the coagulation medium the coagulation reaction will be slow and the accrued graphene ribbon fibers can be drawn. At relatively low concentrations of sulphuric acid in the coagulation medium the coagulation reaction will be fast reducing the drawability of the accrued graphene ribbon fibers. Consequently, by varying the coagulant concentration the drawability of the accrued graphene ribbon fiber can be tuned.

A higher drawability of the accrued graphene ribbon fibers is especially advantageous for fibers comprising long graphene ribbons. Higher acceleration of the accrued graphene ribbon fibers yields a higher orientation of the graphene ribbons in the fibers and consequently higher strengths are obtained in the graphene ribbon fibers.

Alternatively, the temperature of the coagulation medium can be used to control the reaction rate of solvent in the coagulation medium and to control the coagulation speed of the accrued graphene ribbon fibers and thus the drawability of the accrued graphene ribbon fibers.

The coagulation reaction of the spin-dope comprising graphene ribbons in chlorosulfonic acid in a coagulation medium comprising sulphuric acid can be strongly exothermic. Preferably, the heat capacity of the coagulation medium is large enough to avoid boiling of the coagulation medium. The heat capacity of the coagulation bath comprising sulphuric acid as a coagulation medium depends both on the concentration of the sulphuric acid and the temperature of the coagulation bath. The temperature of the coagulation bath should not be below 0° C. to prevent ice forming on the equipment. The temperature of the coagulation bath should be above the melting point of the coagulation medium. When the coagulation medium is water, the temperature of the coagulation bath should be above 0° C. to avoid the formation of ice in the coagulation bath. When using sulphuric acid as coagulation medium the temperature of the coagulation bath has to be maintained carefully, as the melting temperature of sulphuric acid depends strongly on its concentration. Preferably, the temperature of the coagulation bath is in the range of 0° C. to 10° C., more preferably the temperature of the coagulation bath is 5° C., to achieve maximum heat capacity in the coagulant medium without forming ice onto the equipment and/or in the coagulation bath.

The speed of the graphene ribbon fibers and thus the acceleration in the air gap or in the coagulation medium is in general established by the speed of a speed-driven godet, which is preferably located in a position where the graphene ribbon fibers have been neutralized and washed. However, the acceleration of the accrued fibers may also be enhanced by the flow velocity of the coagulation medium when the accrued fibers are spun directly into the coagulation medium or when the accrued graphene ribbon fibers coagulate slowly in the selected coagulation medium.

In the processes according to the invention the coagulation medium flows preferably in the same direction as the graphene ribbon fibers. The flow velocity of coagulation medium can be selected to be lower, equal to or higher than the speed of the graphene ribbon fibers. The flow velocity of the coagulation medium can be used to further tune the coagulation speed of the accrued graphene ribbon fibers, when the coagulation speed is relatively low, e.g. when a coagulation medium is used with a high concentration of sulphuric acid, for example 96% sulphuric acid, or when a coagulation medium is used with an intermediate concentration of sulphuric acid, for example 70% sulphuric acid. Sulfonic acid reacts with water present in the sulphuric acid during coagulation, forming HCl as a vapour and sulphuric acid, which increases the sulphuric acid concentration in the coagulation medium. The ratio of coagulation medium to spin-dope should preferably be large to avoid a significant increase in sulphuric acid concentration.

When the flow velocity of coagulation medium and the speed of graphene ribbon fibers are equal, the effect on coagulation speed will be limited as it is difficult for the coagulation medium to penetrate the bundle of accrued fibers and the coagulation medium is not refreshed at the interface of fiber and coagulation medium. When the flow velocity of coagulation medium is lower than the speed of graphene ribbon fibers, the coagulation effect will be improved as the speed difference ensures that the coagulation medium can penetrate the bundle of accrued fibers. However the refresh rate of coagulation medium at the interface of accrued graphene ribbon fiber and coagulation medium is limited by the formation of a boundary layer. Generally, it is preferred that the flow velocity of coagulation medium is higher than the speed of graphene ribbon fibers to ensure that the coagulation medium can penetrate the bundle of accrued fibers and that there is a high refresh rate of coagulation medium at the interface of fiber and coagulation medium. However, flow velocities of coagulation medium lower or equal to the speed of the graphene ribbon fibers can be desired when the acceleration of the graphene ribbon fibers should not be achieved by a sudden increase in fiber speed, as for example in an air gap, but should be achieved by slowly increasing the fiber speed. The coagulation speed should match the time in which the accrued graphene ribbon fibers are accelerated.

When a coagulation medium is used with a low concentration of sulphuric acid, in the most extreme case 0% sulphuric acid, the coagulation is instantaneous and the flow velocity of the coagulation medium cannot be used to tune the coagulation speed of the accrued graphene ribbon fibers.

Preferably, the coagulation medium flows through a transport tube together with the graphene ribbon fibers. The length of the transport tube depends on the speed of the graphene ribbon fibers and the time required for coagulation of the graphene ribbon fibers. The height difference between the coagulation bath level and the outlet of the transport tube may be used to control the friction force of the coagulation medium on the graphene ribbon fibers to reach the required level. Preferably, the graphene ribbon fibers enter the transport tube directly after entering the coagulation medium to enable hands-free start-up of the process.

Alternatively, the accrued graphene ribbon fibers are spun directly or via an air gap into the coagulation bath, wherein the coagulant medium is essentially a stationary liquid. There can be a minor movement of the coagulant medium in the coagulant bath as some liquid coagulant medium can be dragged along by the graphene ribbon fibers transported through the coagulant bath and/or by a small flow of coagulant medium added to the coagulant bath to replenish the coagulant bath as some coagulant medium will be taken along by the graphene ribbon fibers when leaving the coagulant bath. However, relative to speed of the graphene ribbon fibers, the coagulant bath can be considered to be stationary.

Preferably, the coagulation medium flows through a transport tube together with the graphene ribbon fibers. The use of the transport tube enables hands-free start-up of the process for spinning graphene ribbon fibers. The spin-dope is spun such that the accrued fibers are guided into a coagulation bath. The coagulation medium flows into the transport tube and drags the accrued fibers along into the transport tube. When the coagulated graphene ribbon fibers and the coagulation medium leave the transport tube at the outlet of the transport tube, the graphene ribbon fibers may be picked up by a basket with fixation to catch the yarn during start up and transport the graphene ribbon fibers to the winder.

Preferably, the spinneret, the coagulation bath or coagulation curtain and the neutralizing/washing section are contained within a single enclosure, for example a closed vessel. Any gaseous medium generated by the reaction of the solvent and the coagulation medium, such as $SO_3$ and HCl generated by the reaction of chlorosulfonic acid as solvent with water present in sulphuric acid coagulation medium, can be easily removed from the enclosure through controlled outlets and subsequently treated in a scrubber. The graphene ribbon fibers leave the enclosure through a sealing or cover, which retains any gaseous medium inside the enclosure.

After leaving the transport tube residues from the coagulation medium are partly mechanically stripped off and the graphene ribbon fibers can be washed and neutralized, for example with water/NaOH, before winding-up.

Graphene ribbons as used in this embodiment is to be understood to mean graphene ribbons consisting of a single layer of carbon atoms in a honeycomb arrangement with any length to width ratio. When the length to width ratio of the graphene ribbons is below 1.5, the graphene ribbons are sometimes also called graphene sheets. Graphene ribbons with a length to width ratio above 1.5 are generally called graphene ribbons. To obtain graphene sheets having a length to width ratio below 1.5 from carbon nanotubes, the aspect ratio of the carbon nanotubes, i.e. the length to diameter ratio of the carbon nanotubes, needs to be below 4.7. To obtain graphene ribbons with a length to width ratio above 1.5 from carbon nanotubes, the aspect ratio of the carbon nanotubes needs to be above 4.7. Alternatively, graphene sheets having a length to width ratios below 1.5 can be obtained by cutting larger graphene sheets using chemical methods.

Graphene ribbons with a monodisperse distribution, i.e. all graphene ribbons have the same length and the same width, can be produced by unzipping single wall carbon nanotubes (SWNT), wherein the individual SWNT's all have the same length before unzipping.

When double wall carbon nanotubes (DWNT) all having the same length are unzipped, graphene ribbons with a bidisperse distribution are produced, i.e. the graphene ribbons all have the same length, as the outer wall of the DWNT is unzipped into wider graphene ribbons than the inner wall. Both types of graphene ribbons are present in equal numbers.

When multi wall carbon nanotubes (MWNT) all having the same length are unzipped, graphene ribbons with a polydisperse distribution are produced, i.e. the graphene ribbons all have essentially the same length, but graphene ribbons with different widths are produced as the each wall of the MWNT is unzipped into graphene ribbons with different widths. All types of graphene ribbons with different widths are present in equal numbers. MWNT's can be made up of many concentric nanotubes, for example MWNT's, which consist of 20 concentric nanotubes, yield a mixture of 20 different graphene ribbons types in equal amounts, each of the 20 types having a different width.

When a mixture of carbon nanotubes with different lengths, different diameters and/or different number of walls is unzipped any desired distribution of graphene ribbons can be produced.

The term graphene ribbon fibers used in this invention is to be understood to include the final product as well as any intermediate product of the spun graphene ribbons. It encompasses fibers, fibrils, fibrids, tapes and membranes. It encompasses the liquid stream of spin-dope spun out of the spinning holes of the spinneret, the partly and fully coagulated fibers as present in the coagulation bath or coagulation curtain and/or in the transport tube and it encompasses the stripped, neutralized and/or washed final fiber product.

FIG. 1 schematically represents a process for manufacturing graphene ribbon fibers according to an embodiment. Graphene ribbons are dried and subsequently dissolved in a solvent, preferably a super acid, most preferably chlorosulfonic acid to form a spin-dope. The spin-dope is supplied to a spinneret to form a bundle of accrued fibers. The accrued fibers can be spun directly into a coagulation bath, but preferably the accrued fibers are guided into the coagulation bath via an air gap. In this air gap and/or in the coagulation bath the accrued graphene ribbon fibers are accelerated to increase orientation in the fibers. The air gap avoids direct contact between spinneret and coagulation medium. The sulphuric acid concentration and/or the temperature of the coagulant bath can be used to tune the coagulation speed and to control the drawability of the accrued graphene ribbon fibers and the orientation of the graphene ribbons in the final fiber. The speed of the graphene ribbon fibers is in general established by the speed of a speed-driven godet after the graphene ribbon fibers have been neutralized and washed. The coagulation medium and the accrued fibers are guided into a transport tube, wherein at least a part of the transport tube is at an angle to the gravity direction. Preferably, the transport tube consists of a horizontal part to avoid undesired gravity effects and of a vertical part to collect the accrued fibers when entering the coagulation bath. The coagulated fibers are mechanically stripped of excess coagulation medium and optionally neutralized and washed before winding of the graphene ribbon fibers.

Preferably, the transport tube comprises a vertical part and a horizontal part. The length of the horizontal part of the transport tube depends on the spinning speed and the time required for coagulation of the graphene ribbon fibers. The length of the vertical part of the transport tube depends on the needed height difference between the coagulation bath level and the outlet of the transport tube to ensure that the friction force of the coagulation medium on the graphene ribbon fibers reaches the required level. Preferably, the vertical part starts just below the liquid level of the coagulation bath to optimise the friction forces of the coagulation medium on the graphene ribbon fibers and to enable hands-free start-up of the process.

The use of the transport tube enables hands-free start-up of the process for spinning graphene ribbon fibers. The spin-dope is spun such that the accrued fibers are guided, preferably via an air gap, into a coagulation bath. The coagulation medium flows into the transport tube and drags the accrued fibers along into the transport tube. When the coagulated graphene ribbon fibers and the coagulation medium leave the transport tube at the outlet of the transport tube, the graphene ribbon fibers may be picked up by a basket with fixation to catch the yarn during start up and transport the graphene ribbon fibers to the winder.

Alternatively, the accrued graphene ribbon fibers are spun directly or via an air gap into the coagulation bath, wherein the coagulant medium is essentially a stationary liquid. There can be a minor movement of the coagulant medium in the coagulant bath as some liquid coagulant medium can be dragged along by the graphene ribbon fibers transported through the coagulant bath and/or by a small flow of coagulant medium added to the coagulant bath to replenish the coagulant bath as some coagulant medium will be taken along by the graphene ribbon fibers when leaving the coagulant bath. However, relative to speed of the graphene ribbon fibers, the coagulant bath can be considered to be stationary.

Figure 2:
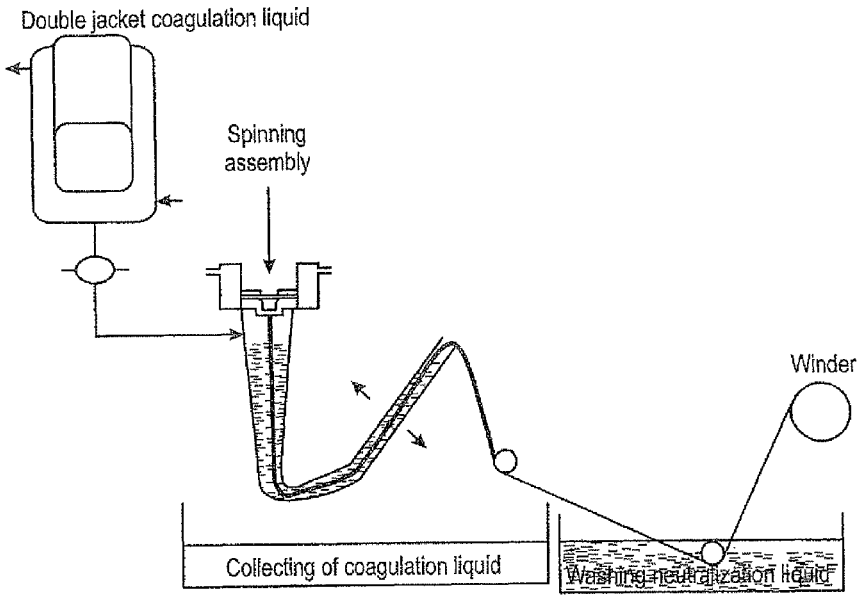
FIG. 2 schematically represents an alternative embodiment of a process for manufacturing graphene ribbon fibers according to an embodiment including a transport tube wherein a part of the transport tube is movable to alter the height of the outlet of the transport tube to adjust the level of coagulation medium in the coagulation bath and thus to increase or decrease the length of the air gap and to adjust the flow velocity of coagulation medium through the transport tube.

FIG. 2 represents an alternative embodiment. A spin-dope is supplied to a spinneret or spinning assembly to form a bundle of accrued fibers. The accrued fibers can be spun directly into a coagulation bath, but preferably the accrued fibers are guided into the coagulation bath via an air gap. In this air gap and/or in the coagulation bath the accrued graphene ribbon fibers are accelerated to increase orientation in the fibers. The air gap avoids direct contact between spinneret and coagulation medium. The sulphuric acid concentration and/or the temperature of the coagulant bath can be used to tune the coagulation speed and to control the drawability of the accrued graphene ribbon fibers and the orientation of the graphene ribbons in the final fiber. The coagulation medium and the accrued fibers are guided into a transport tube, comprising at least two sections, wherein at least a one section of the transport tube can be is movable to alter the height of the outlet of the transport tube. In this way the level of coagulation medium in the coagulation bath can be adjusted to increase or decrease the length of the air gap to influence the orientation in the graphene ribbon fibers and to increase or decrease the flow velocity of coagulation medium through the transport tube. Alternatively, the length of last section of the transport tube can be changed to alter the height of the outlet of the transport tube and thus to increase or decrease the length of the air gap and to change simultaneously the residence time, which generally will be at least the time in which full coagulation of the graphene ribbon fibers is achieved. The flow velocity of coagulation medium through the transport tube can be adjusted by changing the amount of coagulation medium supplied to the coagulation bath and thus to the transport tube. The total length of the transport tube is determined by the coagulation speed of the accrued fibers in the selected coagulation medium. Generally, the length of the transport tube may be adjusted to at least a minimum length to allow full coagulation of the accrued graphene ribbon fibers.

The flow velocity of coagulation medium can be selected to be lower, equal to or higher than the speed of the graphene ribbon fibers. When the flow velocity of coagulation medium and the speed of graphene ribbon fibers are equal, the coagulation effect will be limited as it is difficult for the coagulation medium to penetrate the bundle of accrued fibers and the coagulation medium is not refreshed at the interface of fiber and coagulation medium. When the flow velocity of coagulation medium is lower than the speed of graphene ribbon fibers, the coagulation effect will be improved as the speed difference ensures that the coagulation medium can penetrate the bundle of accrued fibers. However the refresh rate of coagulation medium at the interface of accrued graphene ribbon fiber and coagulation medium is limited by the formation of a boundary layer. Generally, it is preferred that the flow velocity of coagulation medium is higher than the speed of graphene ribbon fibers to ensure that the coagulation medium can penetrate the bundle of accrued fibers and that there is a high refresh rate of coagulation medium at the interface of fiber and coagulation medium. However, flow velocities of coagulation medium lower or equal to the speed of the graphene ribbon fibers can be desired when the acceleration of the graphene ribbon fibers should not be achieved by a sudden increase in fiber speed, as for example in an air gap, but should be achieved by slowly increasing the fiber speed. The coagulation speed should match the time in which the accrued graphene ribbon fibers are accelerated.

The process of this embodiment can advantageously be used at low fiber speeds, for example in the order of 1 m/min for slow coagulation processes, as the flow velocity of the coagulation medium, and thus the difference between flow velocity and fiber speed, can easily be tuned by the supplied flow of coagulation medium.

Figure 3:
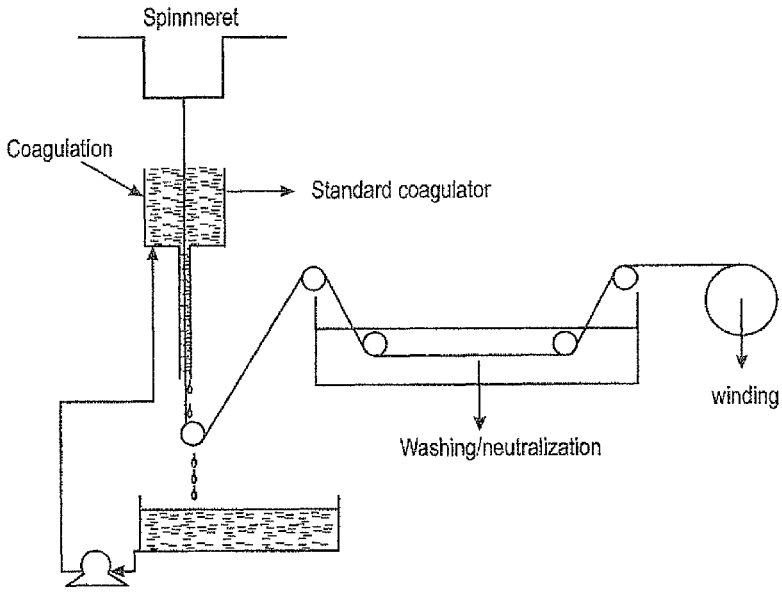
FIG. 3 schematically represents a process for manufacturing graphene ribbon fibers according to an embodiment wherein the coagulated fibers leave the coagulation bath downwards through a vertical tube.

FIG. 3 represents a process for manufacturing graphene ribbon fibers according to an embodiment. A spin-dope is supplied to a spinneret to form a bundle of accrued fibers. The accrued fibers can be spun directly into a coagulation bath, but preferably the accrued fibers are guided into the coagulation bath via an air gap. In this air gap and/or in the coagulation bath the accrued graphene ribbon fibers are accelerated to increase orientation in the fibers. The air gap avoids direct contact between spinneret and coagulation medium. The sulphuric acid concentration and/or the temperature of the coagulant bath can be used to tune the coagulation speed and to control the drawability of the accrued graphene ribbon fibers and the orientation of the graphene ribbons in the final fiber. The coagulation medium and the accrued fibers leave the coagulation bath through a tube at the bottom of the coagulation bath and are transported in the gravity direction, vertically downward. The flow velocity of the coagulation medium is mainly determined by gravity and to a minor extent by friction forces between tube wall and coagulation medium and between the graphene ribbon fibers and the coagulation medium. The flow velocity of the coagulation medium may be about 100 m/min in this embodiment.

The process of this embodiment is suitable when the fiber speed is higher than the flow velocity of the coagulation medium, which is mainly determined by gravity.

Figure 4:
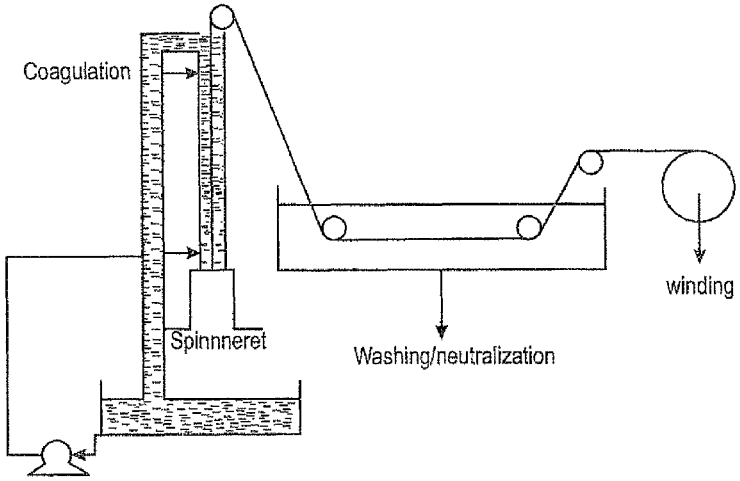
FIG. 4 schematically represents a process for manufacturing graphene ribbon fibers according to an embodiment wherein the accrued fibers are spun directly into a transport tube containing coagulation medium in a vertically upward direction.

FIG. 4 represents a process for manufacturing graphene ribbon fibers according to an embodiment. The accrued fibers are spun directly into the coagulation bath in a vertically upward direction, i.e. in a direction against gravity. An air gap to influence the orientation in the graphene ribbon fibers is not applied in this embodiment. However, the sulphuric acid concentration and/or the temperature of the coagulant bath can be used to tune the coagulation speed and to control the drawability of the accrued graphene ribbon fibers and the orientation of the graphene ribbons in the final fiber. Spinning accrued graphene ribbon fibers in a vertically upward direction is preferred when the density of the accrued graphene ribbon fibers is lower than the density of the coagulation medium. At start-up of the process the accrued fibers may float towards the top end of the tube where the coagulated graphene ribbon fibers can be picked up from the surface. The flow velocity of the coagulation medium is determined by the fluid flow of coagulant medium supplied to the transport tube and the diameter of the transport tube and the flow velocity can be set to a desired value relative to the speed of the graphene ribbon fibers.

The method of spinning accrued fibers in a vertically upward direction is also preferred when the coagulation speed of the accrued fibers in the selected coagulation medium is low. When such slow coagulating graphene ribbon fibers would be spun in an air gap, there is a risk that the accrued fibers break up in small pieces, as gravity forces due to their own weight are higher than the breaking strength of the accrued graphene ribbon fibers. The accrued graphene ribbon fibers spun directly into a coagulation medium in a vertically upward direction are supported by the liquid coagulation medium and will therefore not break up in smaller pieces due to their own weight. The speed of the graphene ribbon fibers is in general established by the speed of a speed-driven godet after the graphene ribbon fibers have been neutralized and washed, but in this embodiment the speed of the accrued fibers can also be increased by the upward flow velocity of the coagulation medium to influence the orientation in the graphene ribbon fibers.

The process of this embodiment can advantageously be used at low fiber speeds, for example in the order of 1 m/min for slow coagulation processes, as the flow velocity of the coagulation medium, and thus the difference between flow velocity and fiber speed, can easily be tuned by the supplied flow of coagulation medium.

Figure 5:
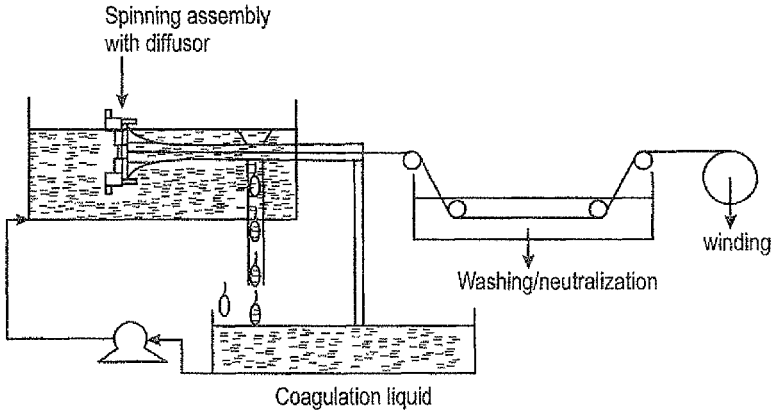
FIG. 5 schematically represents a process for manufacturing graphene ribbon fibers according to an embodiment wherein the accrued fibers are spun directly into a transport tube containing coagulation medium in a horizontal direction and wherein the flow velocity of the coagulation medium in the transport tube is determined by the height difference between the liquid level of the coagulation bath and the outlet of the transport tube.

FIG. 5 represents a process for manufacturing graphene ribbon fibers according to an embodiment. The accrued fibers are spun directly into the coagulation bath in a horizontal direction. An air gap to influence the orientation in the graphene ribbon fibers is not applied in this embodiment. However, the sulphuric acid concentration and/or the temperature of the coagulant bath can be used to tune the coagulation speed and to control the drawability of the accrued graphene ribbon fibers and the orientation of the graphene ribbons in the final fiber. The accrued graphene ribbon fibers are less influenced by gravity forces as the fibers are supported by the liquid coagulation medium and will therefore not break up in smaller pieces under their own weight. Without yarn, the flow velocity of the coagulation medium in the transport tube is determined by the height difference between the liquid level of the coagulation bath and the outlet of the transport tube. Using this principle the position in height of the overflow inlet can be used to control the liquid level of the coagulation bath and to control the friction forces between the coagulation medium and the graphene ribbon fibers during coagulation in and before the transport tube. This embodiment is especially suited to produce a laminar flow of coagulation medium in the transport tube if desired.

The process of spinning accrued graphene ribbon fibers directly into the coagulation medium, either in a horizontal direction, a vertically upward direction or a vertically downward direction, is especially suitable when the accrued graphene ribbon fibers coagulate slowly in the selected coagulation medium. When the accrued graphene ribbon fibers would have a high coagulation speed in the selected coagulation medium there may be a risk that the accrued graphene ribbon fibers start to coagulate directly at the outlet of or even in the spinning holes of the spinneret leading to obstruction of the spinning holes.

The process of this embodiment can advantageously be used at low fiber speeds, for example in the order of 1 m/min for slow coagulation processes, as the flow velocity of the coagulation medium, and thus the difference between flow velocity and fiber speed, can easily be tuned by the supplied flow of coagulation medium.

Figure 6:
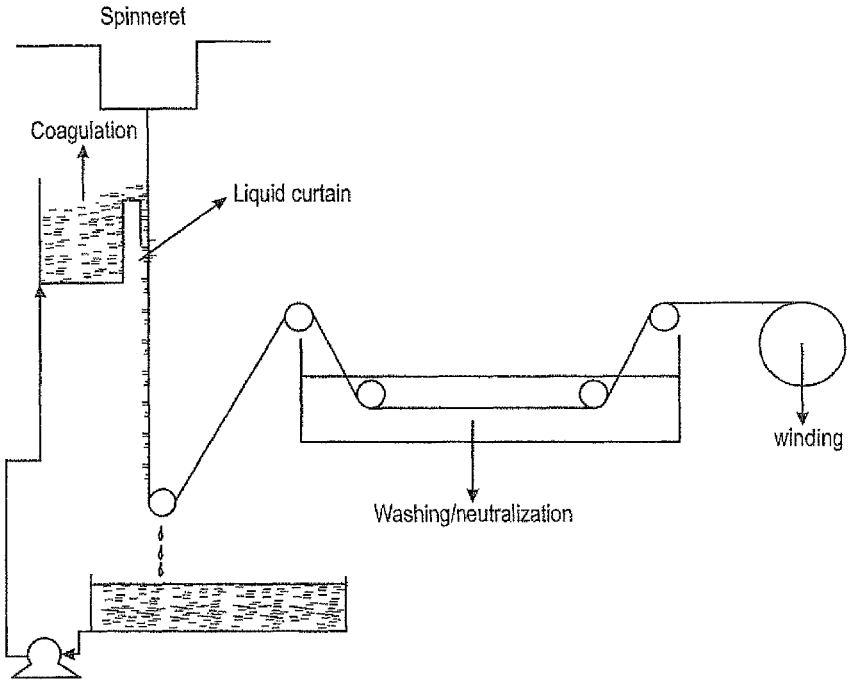
FIG. 6 schematically represents a process for manufacturing graphene ribbon fibers according to an embodiment wherein the accrued fibers are spun into a liquid curtain of coagulation medium.

FIG. 6 represents a process for manufacturing graphene ribbon fibers according to an embodiment. A spin-dope is supplied to a spinneret or spinning assembly to form a bundle of accrued fibers. The accrued fibers can be spun directly into a curtain of liquid coagulation medium, but preferably the accrued fibers are guided into the curtain of coagulation medium via an air gap. In this air gap and/or in the curtain of liquid coagulation medium the accrued graphene ribbon fibers are accelerated to increase orientation of the graphene ribbons in the fibers. The air gap avoids direct contact between spinneret and coagulation medium. The sulphuric acid concentration and/or the temperature of the coagulant bath can be used to tune the coagulation speed and to control the drawability of the accrued graphene ribbon fibers and the orientation of the graphene ribbons in the final fiber. The curtain of coagulation medium can easily be formed by using an overflow system.

The flow velocity of the coagulation medium in this embodiment is mainly determined by gravity and to a minor extent by friction forced between the graphene ribbon fibers and the coagulation medium. The flow velocity of the coagulation medium may be about 100 m/min in this embodiment.

The process of this embodiment is suitable when the fiber speed is higher than the flow velocity of the coagulation medium, which is mainly determined by gravity.

Figure 7:
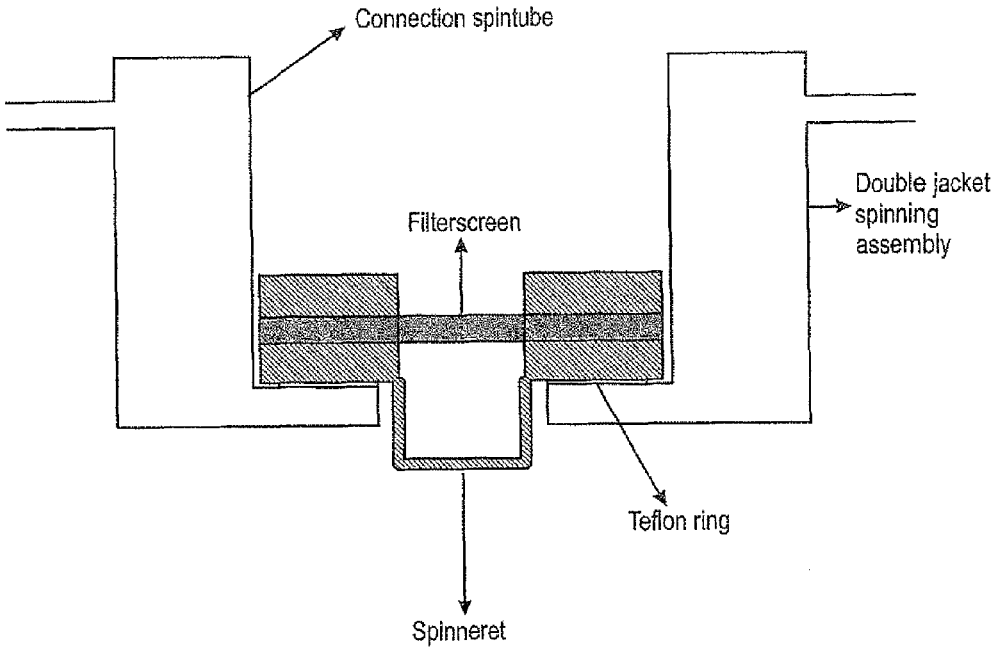
FIG. 7 schematically represents a spinneret suitable to spin graphene ribbon fibers into a coagulation medium.

FIG. 7 schematically represents a spinning assembly suitable to spin graphene ribbon fibers in processes according to an embodiment. The spinneret comprises a double jacket spinning assembly having an inlet and an outlet for a liquid heating medium to ensure that the spin-dope is heated to the optimal temperature. The spin-dope is filtered before entering the spinneret to avoid obstruction of the spinning holes in the spinneret. Preferably, the spinneret containing the spinning holes sticks out from the spinning assembly to avoid direct contact between the heated double jacket spinning assembly and the coagulation medium to ensure that the coagulation medium is not heated up by the heating medium in the double jacket spinning assembly. Furthermore, avoiding direct contact of the coagulation medium with the double jacket spinning assembly is desired as the coagulation medium can be of corrosive nature, as for example with sulphuric acid of high concentrations. The material of the spinneret containing the spinning holes sticking out from the spinning assembly can be selected to withstand the corrosive nature of the coagulation medium and is preferably a ceramic material, for example glass, or a metal such as platinum, gold or tantalium or an alloy of platinum, gold and/or tantalium.

The invention claimed is:

1. A process for spinning graphene ribbons into fibers comprising the steps of:

supplying a spin-dope comprising graphene ribbons to a spinneret, spinning the spin-dope into accrued graphene ribbon fibers, coagulating the accrued graphene ribbon fibers in a coagulation medium to form coagulated graphene ribbon fibers, mechanically stripping, optionally neutralizing and washing the coagulated graphene ribbon fibers, and winding the coagulated graphene ribbon fibers.

2. The process for spinning graphene ribbon fibers according to claim 1, wherein the spin-dope is formed by dissolving the graphene ribbons in a solvent.

3. The process for spinning graphene ribbon fibers according to claim 1, wherein the coagulation medium flows in a same direction as the accrued graphene ribbon fibers.

4. The process for spinning graphene ribbon fibers according to claim 3, wherein the accrued graphene ribbon fibers and the coagulation medium are transported in a vertical direction.

5. The process for spinning graphene ribbon fibers according to claim 4, wherein the accrued graphene ribbon fibers and the coagulation medium are transported in a vertically upward direction.

6. The process for spinning graphene ribbon fibers according to claim 4, wherein the accrued graphene ribbon fibers and the coagulation medium are transported in a vertically downward direction.

7. The process for spinning graphene ribbon fibers according to claim 3, wherein the accrued graphene ribbon fibers and the coagulation medium are transported in a horizontal direction.

8. The process for spinning graphene ribbon fibers according to claim 6, wherein the accrued graphene ribbon fibers and the coagulation medium are transported in a vertically downward direction and in at least one other direction at an angle to the vertical direction.

9. The process for spinning graphene ribbon fibers according to claim 8, wherein the at least one other direction is a horizontal direction.

10. The process for spinning graphene ribbon fibers according to claim 8, wherein the at least one other direction is an angle between a horizontal direction and a vertically upward direction.

11. The process for spinning graphene ribbon fibers according to claim 1, wherein the coagulation medium is sulphuric acid having a concentration in the range of 70% to 96%.

12. The process for spinning graphene ribbon fibers according to claim 11, wherein the coagulation medium is sulphuric acid having a concentration in the range of 90% to 100%.

13. The process for spinning graphene ribbon fibers according to claim 1, wherein a temperature of a coagulation bath is in the range of 0° C. to 10° C.

14. The process for spinning graphene ribbon fibers according to claim 13, wherein the temperature of the coagulation bath is 5° C.

15. The process for spinning graphene ribbon fibers according to claim 6, wherein the accrued graphene ribbon fibers are spun into the coagulation medium by an air gap.

* * * * *

UNITED STATES PATENT AND TRADEMARK OFFICE

CERTIFICATE OF CORRECTION

PATENT NO. : 8,999,212 B2
APPLICATION NO. : 13/636063
DATED : April 7, 2015
INVENTOR(S) : Bernardus Maria Koenders et al.

It is certified that error appears in the above-identified patent and that said Letters Patent is hereby corrected as shown below:

In the Specification

Column 3, line 14, "chiorosulfonic" should be ---chlorosulfonic---.

Column 7, line 39, "a one" should be ---one---.

Column 7, line 39, "can be is" should be ---can be---.

In the Claims

Column 12, line 13, Claim 12, "claim 11" should be ---claim 1---.

Signed and Sealed this
Sixth Day of October, 2015

Michelle K. Lee

Michelle K. Lee
*Director of the United States Patent and Trademark Office*